US005605559A

United States Patent [19]

Unami et al.

[11] Patent Number: 5,605,559

[45] Date of Patent: Feb. 25, 1997

[54] ALLOY STEEL POWDERS, SINTERED BODIES AND METHOD

[75] Inventors: Shigeru Unami; Satoshi Uenosono, both of Chiba, Japan

[73] Assignee: Kawasaki Steel Corporation, Japan

[21] Appl. No.: 392,120

[22] Filed: Feb. 22, 1995

[30] Foreign Application Priority Data

Apr. 15, 1994 [JP] Japan ..... 6-076789

[51] Int. Cl.[6] ..... C22C 38/24; C22C 38/46

[52] U.S. Cl. ..... 75/255; 75/254; 420/106; 420/107; 420/109; 420/110; 420/111

[58] Field of Search ..... 75/252, 254, 255; 148/334; 420/90, 105–111

[56] References Cited

U.S. PATENT DOCUMENTS 4,266,974 5/1981 Nitta et al. ..... 420/107

5,458,670 10/1995 Ogura et al. ..... 75/252

FOREIGN PATENT DOCUMENTS 6-81001 3/1994 Japan ..... 75/255

*Primary Examiner*—George Wyszomierski

*Attorney, Agent, or Firm*—Austin R. Miller

[57] ABSTRACT

Alloy steel powders capable of obtaining high strength in a sintered state and having excellent compacting compressibility and methods of manufacturing a sintered body. The alloy steel powder comprises, by wt %, about 0.5–2% of Cr, not greater than about 0.08% of Mn, about 0.1–0.6% of Mo, about 0.05–0.5% of V, not greater than about 0.015 of S, not greater than about 0.2% of O, and the balance being Fe and incidental impurities. The alloy steel powder is compacted and sintered at a temperature of about 1100°–1300° C. and then cooled at a cooling rate no higher than about 1° C./s in a temperature range of from about 800° C. to 400° C. The alloy steel powder can contain Nb and/or Ti and one or more of Co, W and B. Additionally, Ni powder and/or Cu powder may be adhered and dispersed onto the surface of the alloy steel powder.

48 Claims, 2 Drawing Sheets

ALLOY STEEL POWDERS, SINTERED BODIES AND METHOD

BACKGROUND OF THE INVENTION

1. Field of the Invention

This invention relates to alloy steel powders for manufacturing iron sintered bodies requiring high strength and high compressibility. It further relates to high strength, high compressibility sintered bodies produced, and to a method of manufacturing the sintered bodies.

2. Description of the Related Art

When iron parts requiring high strength are manufactured by conventional powder metallurgy, alloy steel powders are compacted with added strength-enhancing alloy element powders such as Ni, Cu, Mo, Cr and the like. Alternatively, this is done using alloy steel powders made by adding such strength-enhancing alloy elements to molten steel, sintering these alloy steel powders, then carburizing and nitriding and thereafter quenching and tempering the resulting alloy steel powders. Further repeating compacting and sintering of the alloy steel powders, after the first sintering, may be practiced to obtain high strength. It is inevitable, however, that the repetition of the heat treatment and compacting steps increases manufacturing cost. Further, repetition of heat treatment reduces dimensional accuracy of the resulting sintered body.

For example, Cr—Mn alloy steel powders capable of obtaining high strength and exhibiting excellent hardenability are examples of sintered and heat-treated materials whose strength is improved by the addition of strengthening elements (such as Cr) with molten steel (Japanese Patent Publication No. 58(1983)-10962). However, Cr and Mn lower compressibility when powder particles are hardened and compacted, thus shortening the life of a mold. Additional drawbacks include cost increases caused by heat treatments such as quenching, tempering and the like in the manufacturing of steel powders and low dimensional accuracy from the repetition of heat treatments.

Through extensive study, we have discovered remarkable steel powders which can achieve high strength and excellent compressibility after a single sintering operation (omitting the above-described heat treatment). The inventors have proposed Japanese Patent Application Laid-Open No. Hei 4(1992)-165002 and Japanese Patent Application Laid-Open No. Hei 5(1993)-287452 based on these discoveries.

Japanese Patent Application Laid-Open No. Hei 4(1992)-165002 increases the strength of a sintered body by adding Nb and V to Cr alloy powders and utilizing a carbide and nitride precipitation mechanism such that the content of Mn is reduced. Since the powders contain only 0.005–0.08 wt % of V, however, the strengthening effect of the carbides and nitrides of V is lessened. Further, since a large amount of Mo (0.5–4.5 wt %) is used to improve the strength of the sintered body, coarse upper bainite is produced causing the strength of the resulting sintered body to be lower than that of a heat-treated body.

Japanese Patent Application Laid-Open No. 5(1993)-287452 improves strength and fatigue strength by reducing the number of sites of fracture caused by oxide and the like. This is accomplished by further reducing the contents of Mn, P, S in conventional Cr alloy steel powders and limiting the cooling rate after sintering, thereby creating a fine pearlite structure in the sintered body. However, such alloy steel powders are sensitive to the cooling rate after sintering such that the strength of the sintered body is greatly dispersed depending upon the cooling rate. Thus, it is difficult for users to handle these alloy steel powders.

SUMMARY OF THE INVENTION

An object of this invention is to obtain high strength sintered bodies without heat treating and by sintering only once.

A second object of this invention is to obtain alloy steel powders having excellent compressibility for the manufacturing of high-strength sintered bodies.

A third object of this invention is to obtain sintered bodies of stable high strength at a cooling rate typical of a conventional sintering furnace.

A fourth object of this invention is to provide a manufacturing method of obtaining the above sintered bodies.

Through zealous study, we have discovered remarkable alloy steel powders possessing excellent compressibility as well as sintered bodies made from the alloy steel powders that are substantially unaffected by the cooling rate after sintering. More specifically, we have discovered that when these alloy steel powders are used, sintered bodies of fine pearlite structure can be formed without producing coarse upper bainite structures even if the post-sintering cooling rate is not specifically limited. As a result, high strength can be stably obtained even when the sintered bodies are used in the sintered state. Specifically, this invention relates to alloy steel powders which comprise, by wt %, about 0.5–2% of Cr, not greater than about 0.08% of Mn, about 0.1–0.6% of Mo, about 0.05–0.5% of V, not greater than about 0.015% of S, not greater than about 0.2% of O, and the balance being Fe and incidental impurities.

This invention also relates to a method of manufacturing a sintered body having high strength, which comprises the steps of mixing a lubricant and about 0.3–1.2 wt % of graphite powder with the above-described alloy steel powders and compacting and sintering the resultant alloy steel powders.

This invention also relates to a method of manufacturing a sintered body having high strength, which comprises the steps compacting the above-described alloy steel powders and sintering the same at a temperature of about 1100°–1300° C. and cooling at a cooling rate not higher than about 1° C./s in a temperature range of from about 800° C. to about 400° C.

This invention also relates to a sintered body having high strength obtained by the above-described manufacturing method having a structure substantially composed of fine pearlite.

Other features of this invention will be apparent from the appended claims and the detailed description of the invention.

DETAILED DESCRIPTION OF THE INVENTION

This invention will first be described by classifying the components of the alloy steel powders and the sintering conditions.

(1) Components

Cr increases strength through solution hardening. To obtain this effect, Cr must constitute not less than about 0.5 wt %. However, if it constitutes more than about 2 wt %, it decreases the compressibility of steel powders due to the solution hardening of Cr. Thus, Cr content is set to about 0.5–2 wt %. A preferable lower Cr content limit is about 0.6 wt % from the viewpoint of improving strength, and a preferable upper content limit is about 1.2 wt % from the viewpoint of improving compressibility.

Mo improves the strength of steel by solution hardening and precipitation hardening of Mo carbide, and the like. When Mo content is less than about 0.1 wt %, its effect is small. Further, when Mo content exceeds about 0.6 wt %, upper bainite is liable to be produced because Mo greatly delays pearlite transformation during cooling after sintering, thus lowering strength. Therefore, Mo content is set to about 0.1–0.6 wt %. A preferable lower Mo content limit is about 0.15 wt % from the viewpoint of increasing strength, and a preferable upper limit thereof is about 0.4 wt % from the viewpoint of easily producing pearlite.

V improves strength through the precipitation hardening of V carbide and nitride. When the V content is less than about 0.005 wt %, however, the effect is small. Further, when the V content exceeds about 0.5 wt %, strength is lowered from the increased size of the V carbide and nitride precipitates. Thus, the V content is set to about 0.05 wt %–0.5 wt %. In this range, grain sizes are reduced by a pining effect from the V carbides and nitrides so that the hardenability is lowered. Therefore, even if V is added in this range, a base structure of coarse upper bainite is not produced. V content is preferably about 0.1 wt %–0.4 wt %.

Figure 1:
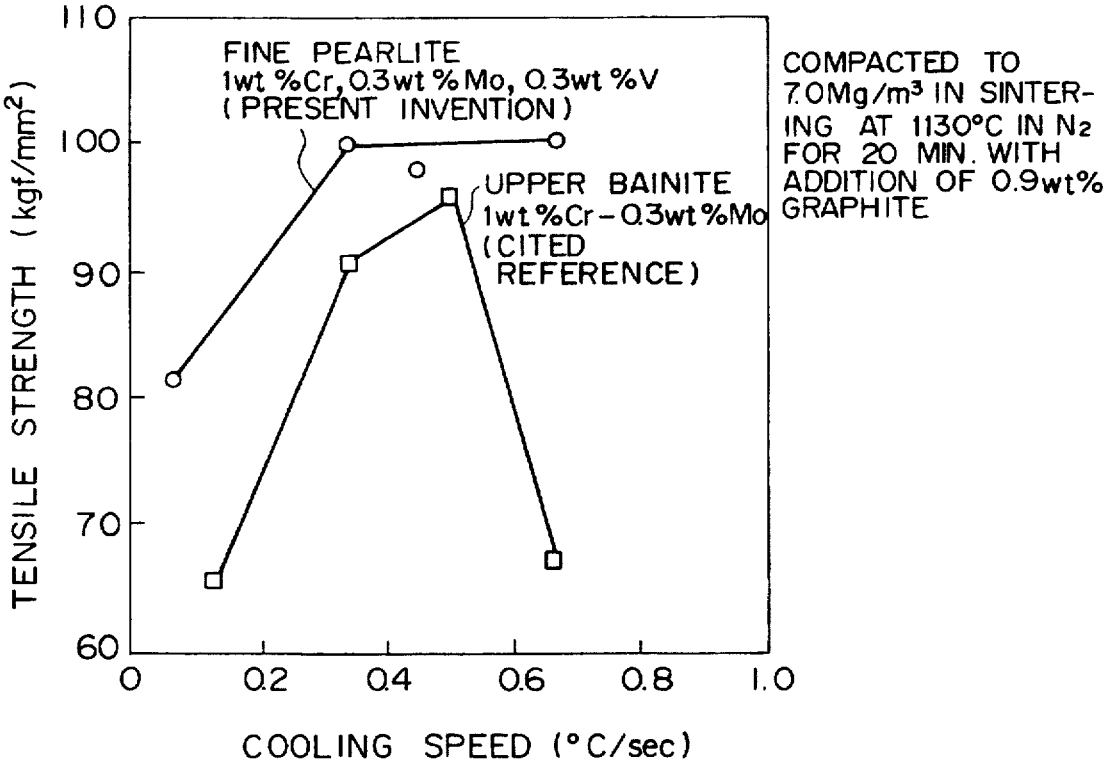
FIG. 1 is a graph showing the relationship between the cooling rate and the tensile strength of a sintered body after sintering.

As shown in FIG. 1, when the cooling rate after sintering exceeds 0.6° C./sec, steel powders of 1 wt % Cr and 0.3 wt % Mo (Japanese Patent Application Laid-Open No. Hei 4 (1994)-165002) which have no added V form an upper bainite structure having little strength. FIG. 1 also shows that such steel powders can be formed into a fine pearlite structure by the addition of 0.3 wt % V even if the cooling rate is 0.6° C./sec or higher, thus securing high strength sintered bodies.

Mn improves the strength of a heat-treated material by improving its hardenability. However, when Mn content exceeds about 0.08 wt %, oxide is produced on the surface of alloy steel powders such that compressibility is lowered and hardenability is increased beyond the required level. Hence, a coarse upper bainite structure is formed and strength is lowered. Mn content is preferably not greater than about 0.06 wt % to improve compressibility. Mn content can be reduced by, for example, increasing the amount of oxygen to be blown into molten steel such that the slag exhibits a high degree of oxidation in the steel making process.

S content is set to an amount not greater than about 0.015 wt %. A consequence of the Mn content being only about 0.08 wt % or less is a reduced production of MnS and an increased solid solution S. When S content exceeds about 0.015 wt %, the amount of solid solution S increases and strength at grain boundaries is lowered. Thus, S content is preferably not greater than about 0.01 wt % to improve strength.

Reducing O content is another feature of this invention. When O content exceeds about 0.2 wt %, oxides are formed with Cr and V which reduce strength and compressibility. O content is preferably limited to not greater than about 0.2 wt % and more preferably to not greater than about 0.15 wt %. O content can be decreased by reducing pressure to about $10^{-2}$ Torr.

Although this invention is fundamentally arranged as described above, an enhanced effect can be obtained through the addition of the following components.

Nb and Ti may be added because strength can be improved by the precipitation hardening of carbides and nitrides of Nb and/or Ti. When the content of Nb and Ti is each less than about 0.01 wt %, their effect is small. Further, when the content of either of them exceeds about 0.08 wt %, the carbide and nitride precipitates of Nb and/or Ti are coarsened, thus lowering strength. Therefore, the content for each of Nb and Ti is about 0.01–0.08 wt %. Since both Nb and Ti produce carbide and nitride in this range, amounts of solid solution Nb and Ti are reduced and hardenability cannot be improved. Thus, even if Nb and/or Ti are added in this range, coarse upper bainite is not produced. A content for each of Nb and Ti is preferably about 0.01 wt %–0.04 wt % to improve strength.

Co, W, B may be added because Co and W improve strength through solution hardening and B improves strength by strengthening grain boundaries. To obtain this effect, the content for each of Co and W is preferably not less than about 0.1 wt %, and the content of B is preferably not less than about 0.001 wt %. When Co and/or W are contained in an amount exceeding about 1 wt %, and B is contained in an amount exceeding about 0.01 wt %, compressibility of steel powders is lowered. Thus, it is preferable to contain Co and W each in the range of about 0.1–1 wt %, and to contain B in the range of about 0.001–0.01 wt %. Further, additions of Co, W and/or B in these ranges does not cause the production of coarse upper bainite. The content for each of Co and W is more preferably about 0.3 wt %–0.8 wt %, and the content of B is more preferably about 0.003 wt %–0.008 wt %.

Ni and/or Cu may be added to increase strength. Diffusion bonding Ni or Cu powder does not reduce compressibility and is therefore the preferred method of adding these alloys. When alloys are added by diffusion bonding, a composite structure of fine pearlite and martensite is formed in the sintered body such that strength is improved. Additive amounts of these alloys are limited to Ni: about 0.5–5 wt % and Cu: about 0.5–3 wt %. When the amount added of each element is less than the respective lower limit amount, the strengthening effects are not observed. Further, when each element exceeds the respective upper limit amount, compressibility abruptly decreases.

Concerning incidental impurities such as P, C, N, Si, Al and the like, it is preferable to limit P to an amount not greater than about 0.015 wt %, C to an amount not greater than about 0.02 wt %, N to an amount not greater than about 0.004 wt %, Si to an amount not greater than about 0.1 wt %, and Al to an amount not greater than about 0.01 wt %. This is because that when P, C, N, Si, Al are present in amounts exceeding their upper limits, they greatly reduce compressibility. It is preferable to limit P to an amount not greater than about 0.01 wt %, C to an amount not greater than about 0.01 wt %, N to an amount not greater than about 0.002 wt %, Si to an amount not greater than about 0.05 wt %, and Al to an amount not greater than about 0.005 wt %.

(2) Sintering Conditions

When the above alloy steel powders are sintered, graphite powder is added in the range of about 0.3–1.2 wt % and about 1 wt % of zinc stearate powder is added as a lubricant, and compacted. Graphite powders are added in the amount of about 0.3–1.2 wt % because C improves steel strength when contained in sintered bodies in an amount not less than about 0.3 wt %. When C is contained in an amount exceeding about 1.2 wt %, however, cementite precipitates and lowers the strength and toughness of the sintered bodies. When the sintering temperature is less than 1100° C., sintering does not proceed well, whereas when the sintering temperature exceeds 1300° C., production costs increase. Thus, the sintering temperature is set to about 1100°–1300° C.

The invention has the .advantage that the cooling rate need not be controlled because a fine pearlite structure can be obtained even at a conventional cooling rate. However, if the cooling rate exceeds about 1° C./s after sintering the steel alloy powder of this invention, a coarse bainite structure is produced which reduces strength. A fine pearlite structure can be obtained by setting the cooling rate to about 1° C./s or less in the temperature range of from about 800° C. to about 400° C. so that the strength of the sintered bodies can be improved. The cooling rate is preferably set to about 0.2°–0.8° C./s.

EXAMPLES

The following examples, directed to specific forms of the invention, are merely illustrative and are not intended to limit the scope of the invention defined in the appended claims.

Example 1

Alloy steel powders having chemical components shown in Table 1 were made through the processes of water atomization, vacuum reduction, and pulverization/classification. The resultant alloy steel powders were added and blended with 1 wt % of zinc stearate and compacted at 6 t/cm$^2$ and subjected to measurements of green density. Further, the alloy steel powders were blended with 0.8 wt % of graphite powders and 1 wt % of zinc stearate powders as a lubricant and then compacted to green compacts having a green density of 7.0 g/cm$^3$. These green compacts were sintered in a $N_2$-10% $H_2$ atmosphere at 1250° C. for 60 minutes and thereafter cooled at a cooling rate of 0.4° C./s in a temperature range of from 800° C. to 400° C. Tensile strengths of the resulting sintered bodies were measured. Table 1 shows the results of the tensile strength and green density measurements.

TABLE 1

| | Chemical Composition (wt %) | | | | | | | | | | Green Density | Tensile Strength | |
|---|---|---|---|---|---|---|---|---|---|---|---|---|---|
| No. | C | Cr | Mo | V | Mn | P | S | Nb | Ti | O | g/cm$^3$ | kgf/mm$^2$ | Reference |
| 1 | 0.005 | 0.6 | 0.25 | 0.14 | 0.04 | 0.004 | 0.002 | — | — | 0.12 | 7.13 | 99 | Example |
| 2 | 0.006 | 1.0 | 0.26 | 0.14 | 0.05 | 0.004 | 0.001 | — | — | 0.13 | 7.12 | 113 | |
| 3 | 0.006 | 1.9 | 0.24 | 0.14 | 0.04 | 0.004 | 0.001 | — | — | 0.11 | 7.08 | 115 | |
| 4 | 0.004 | 1.1 | 0.12 | 0.21 | 0.05 | 0.003 | 0.002 | — | — | 0.10 | 7.12 | 98 | Example |
| 5 | 0.003 | 1.0 | 0.31 | 0.22 | 0.04 | 0.003 | 0.002 | — | — | 0.11 | 7.12 | 112 | |
| 6 | 0.004 | 1.1 | 0.54 | 0.21 | 0.04 | 0.003 | 0.002 | — | — | 0.10 | 7.11 | 113 | |
| 7 | 0.003 | 1.1 | 0.21 | 0.07 | 0.06 | 0.004 | 0.002 | — | — | 0.10 | 7.11 | 95 | Example |
| 8 | 0.004 | 1.0 | 0.20 | 0.29 | 0.06 | 0.004 | 0.002 | — | — | 0.11 | 7.11 | 110 | |
| 9 | 0.004 | 1.0 | 0.20 | 0.43 | 0.06 | 0.004 | 0.002 | — | — | 0.11 | 7.10 | 111 | |
| 10 | 0.005 | 1.1 | 0.26 | 0.14 | 0.02 | 0.004 | 0.001 | — | — | 0.12 | 7.12 | 113 | Example |
| 11 | 0.006 | 1.1 | 0.26 | 0.13 | 0.08 | 0.003 | 0.003 | — | — | 0.13 | 7.10 | 111 | |
| 12 | 0.005 | 1.0 | 0.25 | 0.14 | 0.02 | 0.008 | 0.001 | — | — | 0.10 | 7.09 | 109 | Example |
| 13 | 0.005 | 1.0 | 0.25 | 0.14 | 0.02 | 0.012 | 0.001 | — | — | 0.10 | 7.05 | 108 | |
| 14 | 0.005 | 1.1 | 0.25 | 0.13 | 0.04 | 0.003 | 0.008 | — | — | 0.12 | 7.10 | 103 | Example |
| 15 | 0.005 | 1.1 | 0.25 | 0.14 | 0.04 | 0.003 | 0.012 | — | — | 0.12 | 7.06 | 101 | |
| 16 | 0.005 | 1.5 | 0.30 | 0.19 | 0.06 | 0.002 | 0.003 | 0.02 | — | 0.15 | 7.08 | 113 | Example |
| 17 | 0.006 | 1.5 | 0.30 | 0.20 | 0.05 | 0.002 | 0.003 | 0.04 | — | 0.15 | 7.06 | 115 | |
| 18 | 0.005 | 1.5 | 0.31 | 0.19 | 0.05 | 0.002 | 0.003 | — | 0.02 | 0.15 | 7.08 | 111 | |
| 19 | 0.004 | 1.5 | 0.31 | 0.19 | 0.06 | 0.002 | 0.003 | — | 0.04 | 0.16 | 7.07 | 113 | |
| 20 | 0.005 | 1.5 | 0.30 | 0.19 | 0.06 | 0.002 | 0.003 | 0.03 | 0.06 | 0.14 | 7.06 | 116 | |
| 21 | 0.006 | 2.9 | 0.25 | 0.14 | 0.03 | 0.004 | 0.001 | — | — | 0.12 | 6.98 | 114 | Comparative |
| 22 | 0.005 | 3.9 | 0.24 | 0.13 | 0.05 | 0.004 | 0.002 | — | — | 0.13 | 6.89 | 115 | Example |
| 23 | 0.006 | 4.1 | 0.24 | 0.13 | 0.05 | 0.100 | 0.012 | — | — | 0.17 | 6.74 | 114 | |
| 24 | 0.004 | 1.1 | 0.06 | 0.21 | 0.05 | 0.003 | 0.002 | — | — | 0.10 | 7.12 | 72 | Comparative |
| 25 | 0.003 | 1.0 | 0.90 | 0.22 | 0.04 | 0.003 | 0.002 | — | — | 0.11 | 7.11 | 71 | Example |
| 26 | 0.004 | 1.0 | 0.21 | 0.01 | 0.06 | 0.004 | 0.002 | — | — | 0.12 | 7.11 | 84 | Comparative |
| 27 | 0.005 | 1.0 | 0.20 | 0.70 | 0.06 | 0.004 | 0.002 | — | — | 0.12 | 7.09 | 77 | Example |
| 28 | 0.005 | 1.1 | 0.01 | 0.008 | 0.08 | 0.008 | 0.008 | — | — | 0.10 | 7.12 | 71 | |
| 29 | 0.006 | 1.1 | 0.30 | 0.13 | 0.12 | 0.003 | 0.003 | — | — | 0.13 | 6.98 | 71 | Comparative |
| 30 | 0.015 | 3.6 | 0.39 | 0.32 | 0.17 | 0.015 | 0.015 | — | — | 0.21 | 6.73 | 70 | Example |
| 31 | 0.005 | 1.0 | 0.26 | 0.14 | 0.03 | 0.021 | 0.001 | — | — | 0.12 | 6.91 | 105 | Comparative Example |
| 32 | 0.004 | 1.1 | 0.25 | 0.14 | 0.04 | 0.004 | 0.023 | — | — | 0.13 | 6.91 | 66 | Comparative Example |
| 33 | 0.005 | 1.5 | 0.30 | 0.20 | 0.05 | 0.002 | 0.003 | 0.097 | — | 0.15 | 7.07 | 79 | Comparative Example |
| 34 | 0.004 | 1.5 | 0.30 | 0.19 | 0.05 | 0.002 | 0.003 | — | 0.108 | 0.15 | 7.06 | 81 | Comparative Example |

When specimens Nos. 1, 2 and 3 are compared with specimens Nos. 21 and 22, it is observed that when the content of Cr exceeds 2%, compressibility decreases.

When specimens Nos. 4, 5 and 6 are compared with specimens Nos. 24 and 25, it is observed that when the content of Mo is outside of the range of this invention, strength decreases.

When specimens Nos. 7, 8 and 9 are compared with specimens Nos. 26 and 27, it is observed that when the content of V is outside of the range of this invention, strength decreases.

When specimens Nos. 10 and 11 are compared with a specimen No. 29, it is observed that when the content of Mn exceeds 0.08%, green density and strength decrease.

When specimens Nos. 12 and 13 are compared with a specimens No. 31, it is observed that when the content of P exceeds 0.015%, green density decreases.

When specimens Nos. 14 and 15 are compared with a specimen No. 32, it is observed that when the content of S exceeds 0.015%, green density and strength decrease.

When specimens Nos. 16 and 17 are compared with a specimen No. 33, it is observed that when the content of Nb exceeds 0.08%, strength decreases.

When specimens Nos. 18 and 19 are compared with a specimen No. 34, it is observed that when the content of Ti exceeds 0.08%, strength decreases.

As is apparent from Table 1, utilizing the specified chemical components within the composition ranges of this invention enables the remarkable combination of high compressibility and high strength in the same sintered body.

Example 2

Alloy steel powders having chemical components shown in Table 2 were made through the processes of water atomization, vacuum reduction, and pulverization/classification. The resultant alloy steel powders were added and blended with 1 wt % of zinc stearate as a lubricant, compacted at 6 t/cm$^2$ and subjected to a measurement of green density. Further, the alloy steel powders were blended with 0.9 wt % of graphite powders and 1 wt % of zinc stearate powder as a lubricant and then compacted to green compacts having a green density of 7.0 g/cm$^3$. These green compacts were sintered in a $N_2$-10% $H_2$ atmosphere at 1250° C. for 60 minutes and thereafter cooled at a cooling rate of 0.4° C./s in a temperature range of from 800° C. to 400° C. Tensile strengths of the resulting sintered bodies were measured. Table 2 shows the results of the tensile strength and green density measurements.

TABLE 2

| | Chemical Composition (wt %) | | | | | | | | | | | Green Density | Tensile Strength | |
|---|---|---|---|---|---|---|---|---|---|---|---|---|---|---|
| No. | C | Cr | Mo | V | Mn | P | S | O | N | Si | Al | Mg/cm$^3$ | kgf/mm$^2$ | Reference |
| 35 | 0.106 | 1.1 | 0.28 | 0.29 | 0.05 | 0.003 | 0.003 | 0.18 | 0.002 | 0.05 | 0.004 | 7.11 | 113 | Example |
| 36 | 0.005 | 1.1 | 0.28 | 0.29 | 0.05 | 0.003 | 0.003 | 0.22 | 0.002 | 0.05 | 0.004 | 6.96 | 85 | Comparative Example |
| 37 | 0.013 | 1.1 | 0.28 | 0.29 | 0.05 | 0.003 | 0.003 | 0.12 | 0.002 | 0.05 | 0.004 | 7.08 | 108 | Example |
| 38 | 0.025 | 1.1 | 0.28 | 0.29 | 0.05 | 0.003 | 0.003 | 0.12 | 0.002 | 0.05 | 0.004 | 6.95 | 95 | Comparative Example |
| 39 | 0.006 | 1.0 | 0.29 | 0.31 | 0.06 | 0.003 | 0.003 | 0.13 | 0.008 | 0.04 | 0.004 | 6.94 | 95 | Comparative Example |
| 40 | 0.005 | 1.1 | 0.26 | 0.29 | 0.06 | 0.003 | 0.003 | 0.12 | 0.001 | 0.13 | 0.005 | 6.92 | 91 | Comparative Example |
| 41 | 0.005 | 1.0 | 0.25 | 0.23 | 0.06 | 0.003 | 0.003 | 0.13 | 0.001 | 0.04 | 0.012 | 6.96 | 93 | Comparative Example |

Further, since contents of Cr and P of specimen No. 23 are outside of the ranges of this invention, the observed green density is very low.

Specimen No. 28 shows a composition disclosed in Japanese Patent Application Laid-Open No. Hei 4(1994)-165002. Since the contents of Mo and V are outside of the ranges of this invention, the observed strength is very low.

It is apparent from Table 2 that when any one of the O, C, N, Si and Al quantities exceeds the upper limit of this invention, compressibility and strength decrease.

Example 3

Alloy steel powders having chemical components shown in Table 3 were subjected to measurement of green density and tensile strength under the same conditions as those of Example 2. Table 3 shows the results of the measurements.

TABLE 3

| | Chemical Composition (wt %) | | | | | | | | | | | Green Density | Tensile Strength | |
|---|---|---|---|---|---|---|---|---|---|---|---|---|---|---|
| No. | C | Cr | Mo | V | Mn | P | S | O | Co | W | B | Mg/cm$^3$ | kgf/mm$^2$ | Reference |
| 42 | 0.005 | 0.9 | 0.21 | 0.14 | 0.04 | 0.005 | 0.004 | 0.11 | 0.5 | — | — | 7.07 | 118 | Example |
| 43 | 0.005 | 0.9 | 0.21 | 0.14 | 0.06 | 0.005 | 0.004 | 0.11 | 1.3 | — | — | 6.85 | 95 | Comparative Example |
| 44 | 0.005 | 0.9 | 0.2 | 0.14 | 0.06 | 0.005 | 0.004 | 0.11 | — | 0.3 | — | 7.09 | 119 | Example |
| 45 | 0.004 | 0.9 | 0.21 | 0.14 | 0.06 | 0.005 | 0.004 | 0.11 | — | 1.2 | — | 6.90 | 92 | Comparative Example |
| 46 | 0.005 | 0.9 | 0.2 | 0.14 | 0.05 | 0.005 | 0.004 | 0.11 | — | — | 0.003 | 7.09 | 119 | Example |
| 47 | 0.005 | 0.9 | 0.21 | 0.14 | 0.05 | 0.005 | 0.004 | 0.11 | — | — | 0.012 | 6.88 | 93 | Comparative Example |

Specimen No. 30 shows a composition disclosed in Japanese Patent Publication No. Sho 58(1983)-10962. Since contents of Cr, Mn and Mo are outside of the ranges of this invention, the observed strength is very low.

Although strength of the alloy powder steels is increased by the addition of Co, W or B, it is apparent that if they are added in amounts exceeding the upper limits of the invention, compressibility and strength decrease.

Example 4

Carbonyl nickel powders and copper powders were mixed with alloy steel powder No. 8 shown Table 1 in a predetermined ratio and annealed at 875° C. for 60 minutes in hydrogen gas so that they were partially prealloyed onto the alloy steel powders, thus producing the alloy steel powders of the compositions shown Table 4. The resulting alloy steel powders were subjected to measurement of green density and tensile strength under the same conditions as those of Example 2 except that in this case the amount of graphite powder added was 0.6 wt %. Table 4 shows the results of the measurements.

TABLE 4

| | Chemical Composition (wt %) | | | | | | | | | | Green Density | Tensile Strength | |
|---|---|---|---|---|---|---|---|---|---|---|---|---|---|
| No. | C | Cr | Mo | V | Mn | P | S | O | Ni | Cu | Mg/cm$^3$ | kgf/mm$^2$ | Reference |
| 48 | 0.004 | 1.0 | 0.20 | 0.29 | 0.06 | 0.004 | 0.002 | 0.11 | 4 | — | 7.08 | 120 | Example |
| 49 | 0.004 | 1.0 | 0.20 | 0.29 | 0.06 | 0.004 | 0.002 | 0.11 | 5.5 | — | 6.84 | 95 | Comparative Example |
| 50 | 0.004 | 1.0 | 0.20 | 0.29 | 0.06 | 0.004 | 0.002 | 0.11 | — | 1.5 | 7.07 | 121 | Example |
| 51 | 0.004 | 1.0 | 0.20 | 0.29 | 0.06 | 0.004 | 0.002 | 0.11 | — | 3.5 | 6.85 | 93 | Comparative Example |

Although strength of the alloy powder steels is increased by the addition of Ni or Cu, it is apparent from Table 4 that if they are added in amounts exceeding the upper limits of the invention, strength and compressibility decrease.

Example 5

Alloy steel powder No. 2 shown in Table 1 was added and mixed with 1 wt % graphite powder and 1 wt % zinc stearate and compacted to green compacts having densities of 7.0 g/cm$^3$. These green compacts were sintered in a $N_2$-75% $H_2$ atmosphere at temperatures ranging from 1000°–1300° C. for 30 minutes and then cooled at a cooling rate of 0.3° C./s. The tensile strengths of the resulting sintered bodies were measured, then the tensile strengths were plotted against the respective sintering temperatures to produce the graph in FIG. 2.

Figure 2:
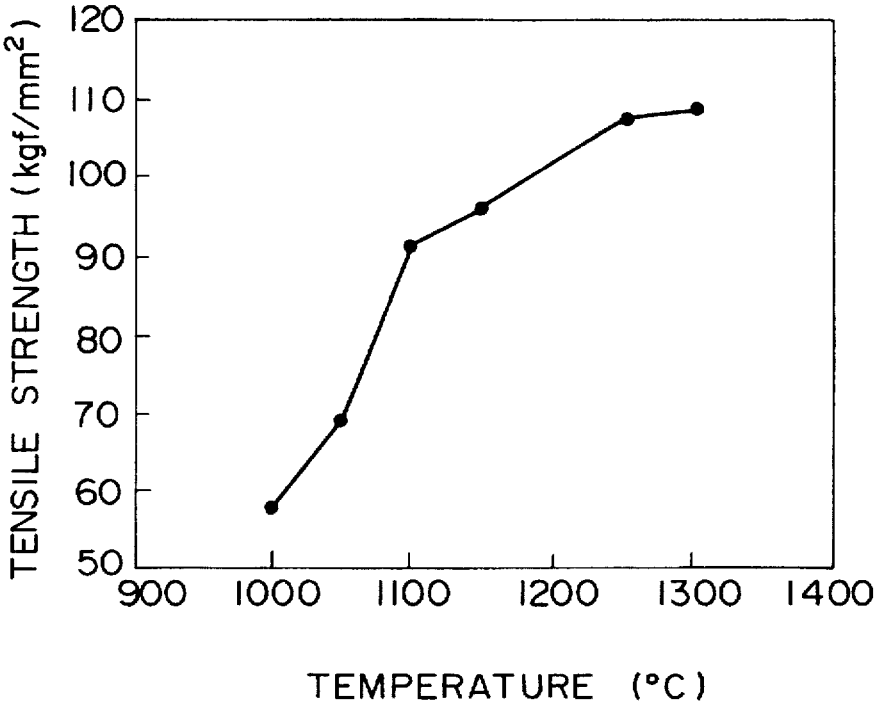
FIG. 2 is a graph showing the relationship between the sintering temperature and the tensile strength of a sintered body.

It is observed in FIG. 2 that high strength is obtained at sintering temperatures not lower than about 1100° C.

Example 6

The Alloy steel powder No. 8 shown in Table 1 was added and mixed with 0.9 wt % graphite powder and 1 wt % zinc stearate and compacted to green compacts having a density of 6.9 g/cm$^3$. These green compacts were sintered in a $N_2$-10% $H_2$ atmosphere at 1250° C. for 60 minutes and then cooled at various cooling rates. The tensile strengths of the resulting sintered bodies were measured, then the tensile strengths were plotted against the respective cooling speeds to produce the graph in FIG. 3.

Figure 3:
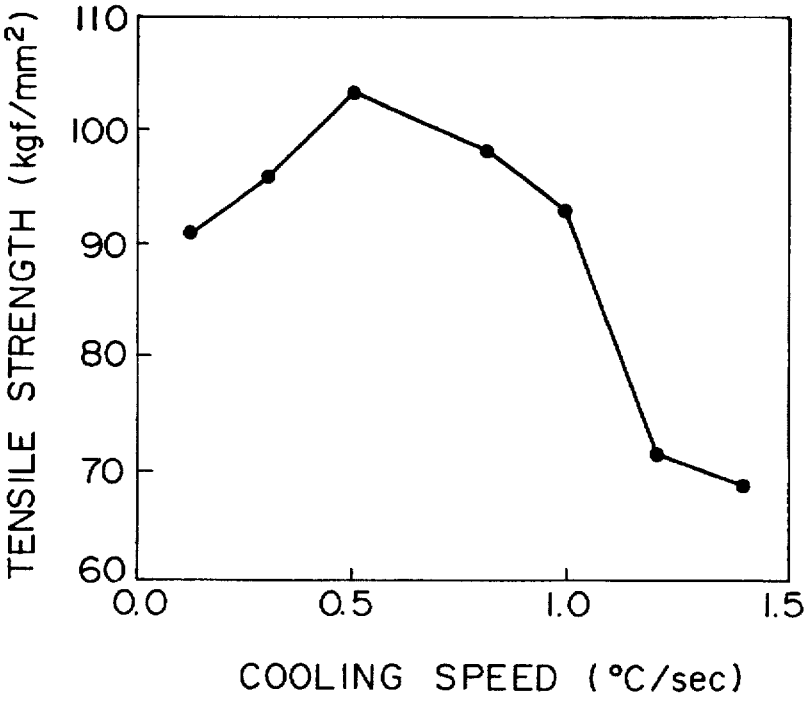
FIG. 3 is a graph showing the relationship between the cooling rate after sintering and the tensile strength of a sintered body.

It is observed in FIG. 3 that high strength is obtained at cooling rates not higher than about 1° C./s.

The alloy steel powders of the invention and the method of manufacturing sintered bodies from the alloy steel powders of the invention enables the production of low cost iron sintered bodies having high strength and excellent compressibility during compacting without conducting post-sintering heat treatments. Additionally, special limits on the cooling rate after sintering are unnecessary, even if the sintered bodies are used in the sintered state. This enables the use of conventional sintering furnaces unequipped with cooling control devices. Moreover, quenching and tempering equipment are not required, further reducing production costs. Also, since compacting and sintering processes need not be repeated after the first sintering process, the invention conserves both manpower and wear on production equipment.

Although this invention has been described with reference to specific forms of apparatus and method steps, equivalent steps may be substituted, the sequence of steps of the method may be varied, and certain steps may be used independently of others. Further, various other control steps may be included, all without departing from the spirit and scope of the invention defined in the appended claims.

What is claimed is:

1. An alloy steel powder for manufacturing a sintered body having high strength, said alloy steel powder comprising, by wt %, about 0.5–2% of Cr, not greater than about 0.08% of Mn, about 0.1–0.6% of Mo, about 0.05–0.5% of V, not greater than about 0.015 of S, not greater than about 0.2% of O, and the balance being Fe and incidental impurities.

2. An alloy steel powder according to claim 1, wherein the content of Cr is about 0.6–1.2 wt %.

3. An alloy steel powder according to claim 1, wherein the content of Mo is about 0.15–0.4 wt %.

4. An alloy steel powder according to claim 1, wherein the content of V is about 0.1–0.4 wt %.

5. An alloy steel powder according to claim 1, wherein the content of Mn is not greater than about 0.06 wt %.

6. An alloy steel powder for manufacturing a sintered body having high strength, said alloy steel powder comprising, by wt %, about 0.5–2% of Cr, not greater than about 0.08% of Mn, about 0.1–0.6% of Mo, about 0.05–0.5% of V, not greater than about 0.015 of S, not greater than about 0.2% of O, one or more components selected from the group consisting of (a) about 0.01–0.08% of Nb and (b) about 0.01–0.08% of Ti, and the balance being Fe and incidental impurities.

7. An alloy steel powder according to claim 6, wherein the content of Cr is about 0.6–1.2 wt %.

8. An alloy steel powder according to claim 6, wherein the content of Mo is about 0.15–0.4 wt %.

9. An alloy steel powder according to claim 6, wherein the content of V is about 0.1–0.4 wt %.

10. An alloy steel powder according to claim 6, wherein the content of Mn is not greater than about 0.06 wt %.

11. An alloy steel powder according to claim 6, wherein the content of Nb is about 0.01–0.04 wt %.

12. An alloy steel powder according to claim 6, wherein the content of Ti is about 0.01–0.04 wt %.

13. An alloy steel powder according to claim 6, wherein the alloy steel powder further contains, by wt %, one or more components selected from the group consisting of (a) about 0.1–1% of Co, (b) about 0.1–1% of W and (c) about 0.001–0.01% of B.

14. An alloy steel powder according to claim 13, wherein the content of Nb is about 0.01–0.04 wt %.

15. An alloy steel powder according to claim 13, wherein the content of Ti is about 0.01–0.04 wt %.

16. An alloy steel powder according to claim 6, wherein the alloy steel powder contains, by wt %, one or more incidental impurities selected from the group consisting of (a) P in an amount not greater than about 0.015%, (b) C in an amount not greater than about 0.02%, (c) N in an amount not greater than about 0.004%, (d) Si in an amount not greater than about 0.1%, and (e) Al in an amount not greater than about 0.01%.

17. An alloy steel powder according to claim 16, wherein the content of Nb is about 0.01–0.04 wt %.

18. An alloy steel powder according to claim 16, wherein the content of Ti is about 0.01–0.04 wt %.

19. An alloy steel powder according to claim 6, wherein the alloy steel powder further comprises, by wt %, one or more component powders selected from the group consisting of (a) about 0.5–5% of Ni, and (b) about 0.5–3% of Cu, added by mixing and partially prealloying the component powders onto the alloy steel powder.

20. An alloy steel powder according to claim 19, wherein the content of Nb is about 0.01–0.04 wt %.

21. An alloy steel powder according to claim 19, wherein the content of Ti is about 0.01–0.04 wt %.

22. An alloy steel powder for manufacturing a sintered body having high strength, said alloy steel powder comprising, by wt %, about 0.5–2% of Cr, not greater than about 0.08% of Mn, about 0.1–0.6% of Mo, about 0.05–0.5% of V, not greater than about 0.015 of S, not greater than about 0.2% of O, one or more components selected from the group consisting of (a) about 0.1–1% of Co, (b) about 0.1–1% of W and (c) about 0.001–0.01% of B and the balance being Fe and incidental impurities.

23. An alloy steel powder according to claim 22, wherein the content of Cr is about 0.6–1.2 wt %.

24. An alloy steel powder according to claim 22, wherein the content of Mo is about 0.15–0.4 wt %.

25. An alloy steel powder according to claim 22, wherein the content of V is about 0.1–0.4 wt %.

26. An alloy steel powder according to claim 22, wherein the content of Mn is not greater than about 0.06 wt %.

27. An alloy steel powder according to claim 22, wherein the content of Co is about 0.3–0.8 wt %.

28. An alloy steel powder according to claim 22, wherein the content of W is about 0.3–0.8 wt %.

29. An alloy steel powder according to claim 22, wherein the content of B is about 0.003–0.008 wt %.

30. An alloy steel powder according to claim 18, wherein the alloy steel powder contains, by wt %, one or more incidental impurities selected from the group consisting of (a) P in an amount not greater than about 0.015%, (b) C in an amount not greater than about 0.02%, (c) N in an amount not greater than about 0.004%, (d) Si in an amount not greater than about 0.1%, and (e) Al in an amount not greater than about 0.01%.

31. An alloy steel powder according to claim 30, wherein the content of Co is about 0.3–0.8 wt %.

32. An alloy steel powder according to claim 30, wherein the content of W is about 0.3–0.8 wt %.

33. An alloy steel powder according to claim 30, wherein the content of B is about 0.003–0.008 wt %.

34. An alloy steel powder according to claim 18, wherein the alloy steel powder further comprises, by wt %, one or more component powders selected from the group consisting of (a) about 0.05–5% of Ni, and (b) about 0.5–3% of Cu, added by mixing and partially prealloying the component powders onto the alloy steel powder.

35. An alloy steel powder according to claim 34, wherein the content of Co is about 0.3–0.8 wt %.

36. An alloy steel powder according to claim 34, wherein the content of W is about 0.3–0.8 wt %.

37. An alloy steel powder according to claim 34, wherein the content of B is about 0.003–0.008 wt %.

38. An alloy steel powder for manufacturing a sintered body having high strength, said alloy steel powder comprising, by wt %, about 0.5–2% of Cr, not greater than about 0.08% of Mn, about 0.1–0.6% of Mo, about 0.05–0.5% of V, not greater than about 0.015 of S, not greater than about 0.2% of O, and the balance being Fe and incidental impurities, with one or more of the incidental impurities selected from the group consisting of (a) P in an amount not greater than about 0.015%, (b) C in an amount not greater than about 0.02%, (c) N in an amount not greater than about 0.004%, (d) Si in an amount not greater than about 0.1%, and (e) Al in an amount not greater than about 0.01%.

39. An alloy steel powder according to claim 38, wherein the content of Cr is about 0.6–1.2 wt %.

40. An alloy steel powder according to claim 38, wherein the content of Mo is about 0.15–0.4 wt %.

41. An alloy steel powder according to claim 38, wherein the content of V is about 0.1–0.4 wt %.

42. An alloy steel powder according to claim 38, wherein the content of Mn is not greater than about 0.06 wt %.

43. An alloy steel powder according to claim 38, wherein the alloy steel powder further comprises, by wt %, one or more component powders selected from the group consisting of (a) about 0.5–5% of Ni, and (b) about 0.5–3% of Cu, added by mixing and partially prealloying the component powders onto the alloy steel powder.

44. An alloy steel powder for manufacturing a sintered body having high strength, said alloy steel powder comprising, by wt %, about 0.5–2% of Cr, not greater than about 0.08% of Mn, about 0.1–0.6% of Mo, about 0.05–0.5% of V, not greater than about 0.015 of S, not greater than about 0.2% of O, and the balance being Fe and inevitable impurities, and, in addition, mixed and partially prealloyed onto the alloy steel powder one or more component powders selected from the group consisting of (a) about 0.5–5% of Ni, and (b) about 0.5–3% of Cu.

45. An alloy steel powder according to claim 44, wherein the content of Cr is about 0.6–1.2 wt %.

46. An alloy steel powder according to claim 44, wherein the content of Mo is about 0.15–0.4 wt %.

47. An alloy steel powder according to claim 44, wherein the content of V is about 0.1–0.4 wt %.

48. An alloy steel powder according to claim 44, wherein the content of Mn is not greater than about 0.06 wt %.

* * * * *

UNITED STATES PATENT AND TRADEMARK OFFICE

CERTIFICATE OF CORRECTION

PATENT NO. : 5,605,559

DATED : February 25, 1997

INVENTOR(S) : Shigeru Unami and Satoshi Uenosono

It is certified that error appears in the above-indentified patent and that said Letters Patent is hereby corrected as shown below:

Columns 7 and 8, in Table 3, 5th Row, 13th Column, please change "7.09" to --7.08--.

Signed and Sealed this

Twenty-ninth Day of April, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,605,559
DATED : February 25, 1997
INVENTOR(S) : Shigeru Unami et al It is certified that error appears in the above-indentified patent and that said Letters Patent is hereby corrected as shown below:

Column 11, line 53, please change "18" to --22--.

Column 12, line 5, please change "18" to --22--.

Signed and Sealed this

Ninth Day of September, 1997

*Attest:*

*Attesting Officer*

BRUCE LEHMAN

*Commissioner of Patents and Trademarks*